US005996686A

United States Patent [19]

Thors et al.

[11] Patent Number: 5,996,686

[45] Date of Patent: Dec. 7, 1999

[54] HEAT TRANSFER TUBES AND METHODS OF FABRICATION THEREOF

[75] Inventors: Petur Thors; Norman R. Clevinger; Bonnie J. Campbell, all of Decatur; James T. Tyler, Hartselle, all of Ala.

[73] Assignee: Wolverine Tube, Inc., Decatur, Ala.

[21] Appl. No.: 08/834,251

[22] Filed: Apr. 15, 1997

Related U.S. Application Data

[60] Provisional application No. 60/015,516, Apr. 16, 1996.

[51] Int. Cl.[6] ..... F28F 1/42

[52] U.S. Cl. ..... 165/179; 165/133; 165/184

[58] Field of Search ..... 165/133, 179, 165/184

[56] References Cited

U.S. PATENT DOCUMENTS

| | | | |
|---|---|---|---|
| 3,088,494 | 5/1963 | Koch et al. | 165/179 X |
| 3,217,799 | 11/1965 | Rodgers | 165/179 |
| 3,847,212 | 11/1974 | Withers, Jr. et al. | 165/179 |
| 4,330,036 | 5/1982 | Satoh et al. | 165/179 |
| 4,546,819 | 10/1985 | O'Connor | 165/179 X |
| 4,729,155 | 3/1988 | Cunningham et al. | 29/890.048 |
| 4,921,042 | 5/1990 | Zohler | 165/179 |
| 5,186,252 | 2/1993 | Nishizawa et al. | 165/133 X |
| 5,259,448 | 11/1993 | Masukawa et al. | 165/133 |
| 5,415,225 | 5/1995 | Randlett et al. | 165/133 |
| 5,690,167 | 11/1997 | Rieger | 165/133 |

*Primary Examiner*—Leonard Leo
*Attorney, Agent, or Firm*—Barry L. Clark

[57] ABSTRACT

Heat transfer tubes have an exterior surface in contact with a refrigerant and an interior surface defining a path through which a liquid is conveyed in an axial direction of the tube. The exterior surface of the tube has a plurality of fins formed thereon; the interior surface of the tube has a plurality of ridges formed thereon. The fins have an average width v with respect to the axial direction of the tube and a pitch Q with respect to the axial direction of the tube. A channel is provided between adjacent fins, the channels having a channel bottom of length L with respect to the axial direction of the tube. The ridges have a ridge height (e) and a ridge base width (b). The tubes have a ratio of L/v in a range of from 1.22 to 3.40. L is greater than 45% of fin pitch Q, and is preferably between 45% and 75% of fin pitch Q. A ratio of (e×L)/b is in a range of from 0.0062 to 0.0165; a ratio of e/b is in a range of from 0.565 to 0.973.

9 Claims, 8 Drawing Sheets

$Dp_e/Dp_s$ vs. Flow Rate:

Ste/Sts vs. Flow Rate:

η vs. Flow Rate

HEAT TRANSFER TUBES AND METHODS OF FABRICATION THEREOF

This application claims the benefit of U.S. Provisional Application No. 60/015,516 filed Apr. 16, 1996.

BACKGROUND

1. Field of Invention

This invention pertains to mechanically formed heat transfer tubes including those employed in various refrigerant condensation and/or boiling applications.

2. Related Art and Other Considerations

Refrigeration apparatus is generally operated both with condenser tubes and boiling (evaporator) tubes. In submerged chiller refrigerating applications, the outside of a boiling tube is submerged in a refrigerant to be boiled, while the inside conveys liquid, usually water, which is chilled as it gives up its heat to the tube and refrigerant. In a condenser tube, on the other hand, refrigerant vapor on the outside of the tube is cooled by a liquid conveyed inside the condenser tube, so that liquid refrigerant condenses on the exterior of the tube and can drip away from the condenser tube.

An outer surface of heat transfer tubes (such as boiling tubes and condenser tubes) typically has fins formed thereon, the fins extending (at least in part) in a direction parallel to a radius of the tube. Heat transfer has also been enhanced by modifying the inner surface of the tube, e.g., by ridges on the tube inner surface, as taught (for example) in U.S. Pat. No. 3,847,212 to Withers, Jr. et al. (incorporated herein by reference). Withers specifically relates an improved heat transfer coefficient to a ridge-dependent severity factor $\Phi=e^2/pd_i$ (where e is average height of a ridge, p is the average pitch of the ridges, and $d_i$ is the maximum projected internal diameter of the tube, all measured in inches). Various tubes produced in accordance with the Withers patent have been marketed by Wolverine Tube, Inc., under the trademark TURBO-CHIL®.

FIG. 1 illustrates a portion of a prior art condensing tube 20 manufactured by Wolverine Tube, Inc., and known in the industry as Turbo-CII™. On its tube wall 21, tube 20 of FIG. 1 has fins 22 formed in planes perpendicular to the tube's longitudinal axis 24. Between roots of adjacent fins 22 on the exterior surface 25 of tube 20 is a ravine-shaped channel 26. Channel 26 has a rounded bottom which forms a pocket wherein liquid refrigerant forms in pools 28 during condensation. Eventually the refrigerant which pools in channel 26 is drained away by gravity from an underside of the tube. However, as the depth of the pooled refrigerant 28 increases in channel 26, the distance between tube wall 21 and the refrigerant vapor 29 which is being condensed also increases and constitutes an increased resistance to condensation of more vapor.

Tube 20 also has helical ridges 30 formed on an inner surface 32. Ridges 30 have a predetermined ridge height and pitch and are positioned at a predetermined helix angle. The ridge height e of tube 20 shown in FIG. 1 is 0.015 inch; the inner diameter $D_i$ of tube 20 is 0.612 inch.

Other parameters of interest for tube 20 are the thickness of the tube wall x and the height g of the fins 22 from tube exterior surface 25. For tube 20, x is 0.028 inch and g is 0.040 inch.

The rounded shape of the bottoms of channels 26 results from the configuration of tooling applied to tube exterior surface 25 for forming fins 22. In particular, a series of rotating finning disks (not shown) are employed, in sequence, to apply a force to the tube exterior surface in a manner both to push metal on the exterior outwardly so as to form the fins 22 and to slightly elongate tube 20. Simultaneously, the internal ridges 30 are formed on a mandrel (not shown, which has grooves which are complementary to the ridges). Conventionally, the radially outermost forming portions of the finning disks, as viewed in axial cross section, are rounded (i.e., the finning disks have a profile corresponding to the shape of channels 26). Each of the finning disks in the series has essentially the same rounded profile, with each finning disk in the sequence digging progressively deeper into the tube metal.

It is an object of the present invention to increase heat transfer in boiling and condensing tubes, e.g., by widening and preferably substantially flattening the channels between roots of adjacent fins, thereby reducing the depth of refrigerant pooled in the channels.

SUMMARY

Heat transfer tubes have an exterior surface in contact with a refrigerant and an interior surface defining a path through which a liquid is conveyed in an axial direction of the tube. The exterior surface of the tube has a plurality of fins formed thereon; the interior surface of the tube has a plurality of ridges formed thereon. The fins have an average width v with respect to the axial direction of the tube and a pitch Q with respect to the axial direction of the tube. A channel is provided between adjacent fins, the channels having a channel bottom of length L with respect to the axial direction of the tube. The ridges have a ridge height (e) and a ridge base width (b). The tubes have a ratio of L/v in a range of from 1.22 to 3.40. L is greater than 45% of fin pitch Q, and is preferably between 45% and 75% of fin pitch Q. A ratio of (e×L)/b is in a range of from 0.0062 to 0.0165; a ratio of e/b is in a range of from 0.565 to 0.973.

BRIEF DESCRIPTION OF THE DRAWINGS

The foregoing and other objects, features, and advantages of the invention will be apparent from the following more particular description of preferred embodiments as illustrated in the accompanying drawings in which reference characters refer to the same parts throughout the various views. The drawings are not necessarily to scale, emphasis instead being placed upon illustrating the principles of the invention.

DETAILED DESCRIPTION OF THE DRAWINGS

Figure 2:
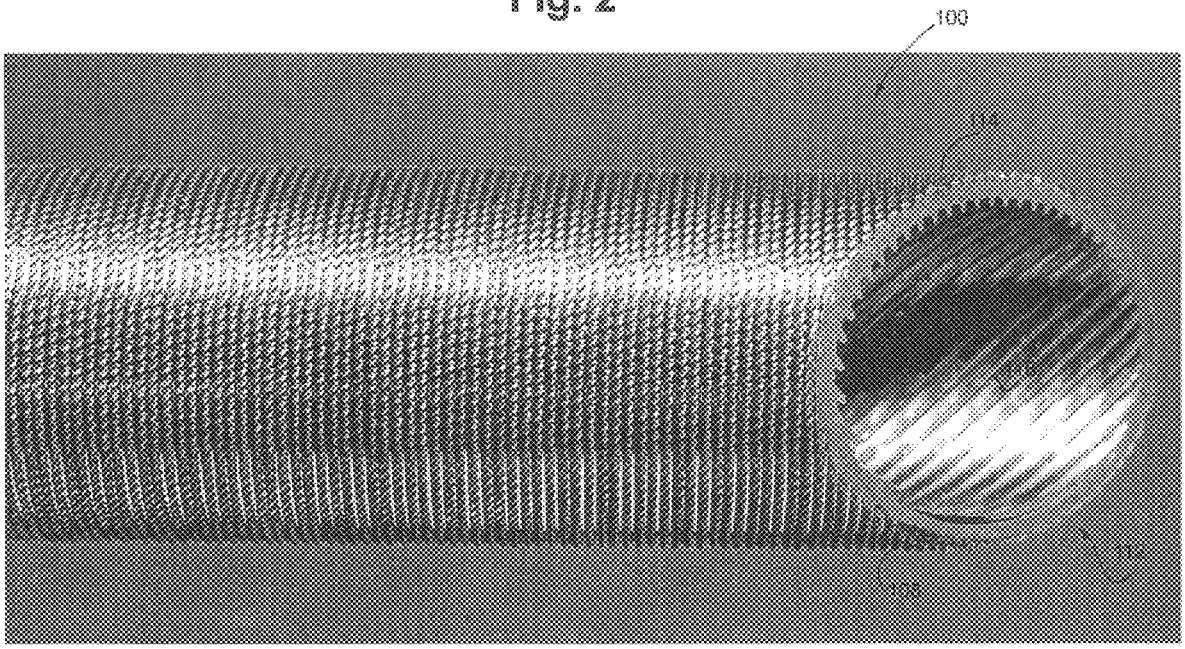
FIG. 2 is a perspective view of a heat transfer tube according to an embodiment of the invention.

FIG. 2 shows heat transfer tube 100 according to an embodiment of the invention. The tube 100 comprises a tube wall 108 having a deformed outer surface (indicated generally at 112) and a ridged inner surface (indicated generally at 114). Tube 100 of the FIG. 2 embodiment has a nominal outer diameter of ¾ inches. It should be understood that principles of the invention are applicable to tubes of other nominal outer diameters, such as the common 1 inch and ⅝ inch sizes, for example. In the illustrated embodiment, tube wall 108 has a thickness x of 0.028 inch.

Figure 3:
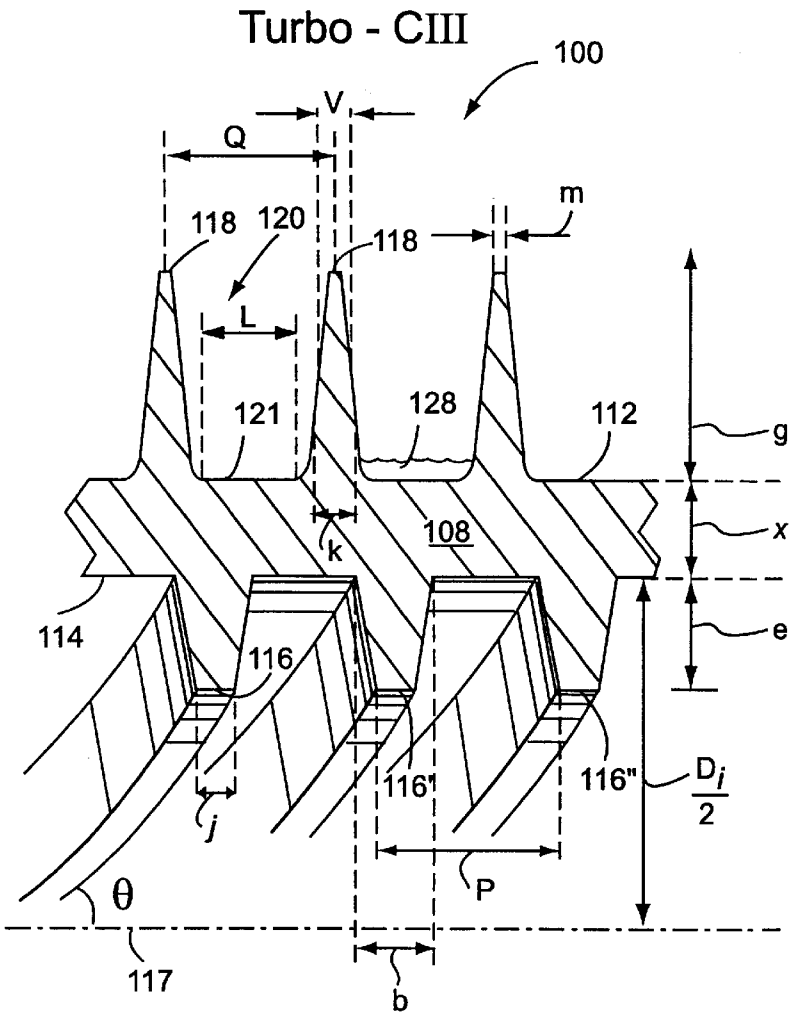
FIG. 3 is an enlarged, partially broken away axial cross-sectional view of the heat transfer tube of FIG. 2.

FIG. 3 shows an enlarged fragmentary portion of tube 100 in axial cross-section. Inner surface 114 of tube 100 comprises a plurality of ridges, such as ridges 116, 116', 116" (generically referred to as ridges 116). Ridges 116 have their axial pitch "p", their ridge width "b" (as measured axially at the ridge base), and their average ridge height "e" measured as indicated by correspondingly alphabetized dimension arrows shown in FIG. 3. The helix lead angle "θ" is measured from the axis 117 of the tube 100.

Tube 100 shown in FIG. 3 has 34 ridge starts; a pitch of 0.0584 inch; a ridge helix angle θ of 45 degrees; an average ridge height e of 0.019 inch; an average ridge base width b of 0.0255 inch; an average ridge crown width "j" of 0.008 inch. The inner diameter $D_i$ of tube 100 is 0.639 inch.

The parameters of tube 100 enhance the inside heat transfer coefficient by providing, e.g., increased surface area and also permitting the fluid inside tube 100 to swirl as it traverses the length of tube 100. The swirling flow tends to keep the fluid in good heat transfer contact with the inner surface 114 but avoids excessive turbulence which could provide an undesirable increase in pressure drop.

In fact, ridges 116 have a greater height (e) but are thinner than prior art ridges of comparable pitch. The greater ridge height facilitates increased heat transfer. Thinner ridges reduce the metal weight, and consequently the cost, of tube 100.

Outer surface 112 of tube 100 is formed to have a plurality of fins 118 provided thereon. Fins 118 are formed on an arbor finning machine in a manner understood with reference to U.S. Pat. No. 4,729,155 to Cunningham et al. (incorporated herein by reference), for example. However, as explained hereinafter with particular reference to FIG. 5, the arbors or finning disks employed for the present invention are configured differently from the prior art. The number of arbors utilized depends on such manufacturing factors as tube size, throughput speed, etc. The arbors are mounted at appropriate degree increments around the tube, and each is preferably mounted at an angle relative to the tube longitudinal axis 117.

The finning disks push metal on tube outer surface 112 outwardly so as to form a plurality of fins 118 and consequently form respective channels 120 between adjacent fins 118. Channels 120 are generally circumferential about tube 100 and, in contrast to prior art tubes, have a wide and preferably flat channel bottom 121, as shown in FIG. 3.

Figure 4:
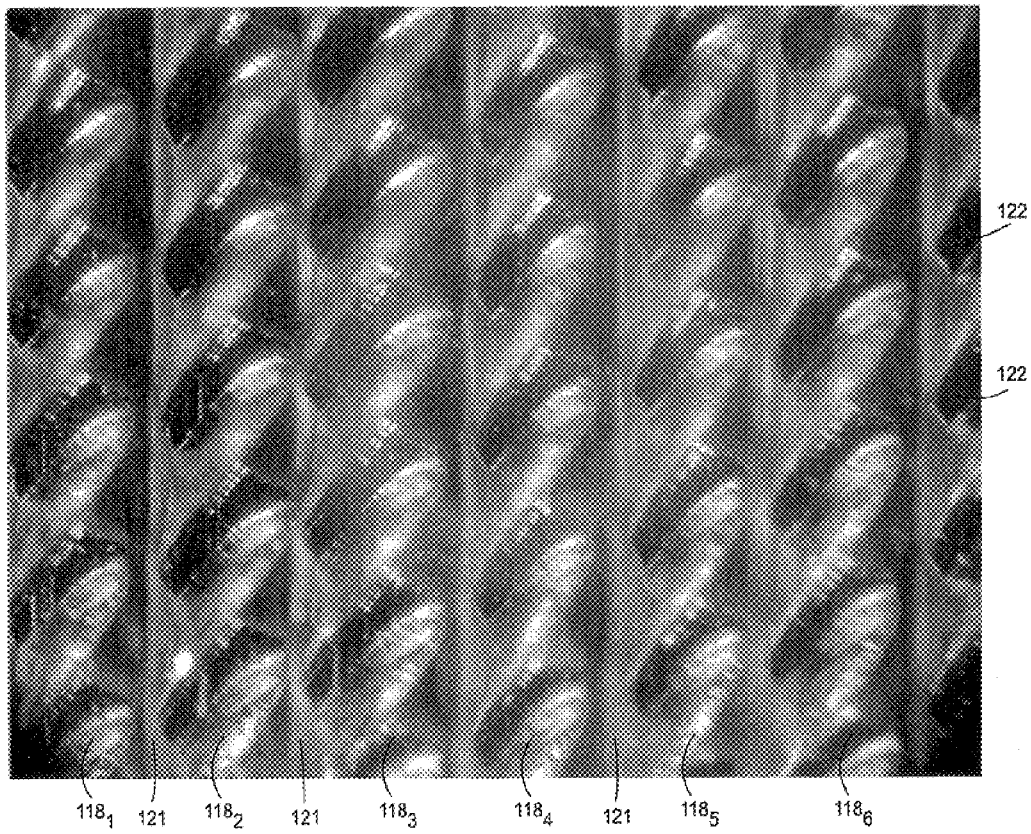
FIG. 4 is an enlarged view of an exterior surface of the heat transfer tube of FIG. 2.

After fin formation, outer surface 112 of tube 100 is notched to provide a plurality of notches 122. The notching is accomplished using a notching disk (also understood with reference to U.S. Pat. No. 4,729,155 to Cunningham et al.). The notching of tube outer surface 112 is seen in FIG. 4, wherein fins 118 appear vertically oriented with portions of channel bottoms 121 visible therebetween. In FIG. 4, fins 118 are depicted with lighter shading while the notches 122 appear darker. Notches 122 are arranged at angles less than 80° relative to the tube axis 117. Notches 122 are preferably spaced around a circumference of each fin 118 from each other (as measured along the circumference of fin 118 at a base of the notches) in a range of 0.016 inch to 0.034 inch, and in the illustrated embodiment are spaced at a distance of 0.25 inch. Since the notching of fins 118 precludes full vision of channels 120 in FIG. 4, it should be understood that channels 120 are much broader (with respect to the horizontal orientation of FIG. 4) than visibly apparent in FIG. 4.

In the illustrated embodiment, the spacing of fins 118 of tube 100 is 43 fins per inch. That is, the plurality of helical fins 118 are axially spaced at a pitch Q of 0.0233 inch.

Whereas average fin height g (see FIG. 3) in prior art tubes is on the order of 0.038 inch, for the present invention average fin height is below 0.028 inch. In the illustrated embodiment, fin height is in a range of between 0.020 and 0.028 inch, and more preferably in a range of between 0.023 and 0.024 inch (after the tube has been notched).

Significantly, fins 118 are thinner than prior art fins. At their bases, on average fins 118 have a width k of 0.009 inch, while at on average their crowns fins 118 have a width m of 0.005 inch. An average intermediate width v of fins 118 is 0.007 inch.

Thus, fins 118 of tube 100 of the present invention are lower and thinner than fins for prior art tubes. Lower fins 118 are suitable in apparatus such as refrigerant chillers which require lower heat flux.

Figure 1:
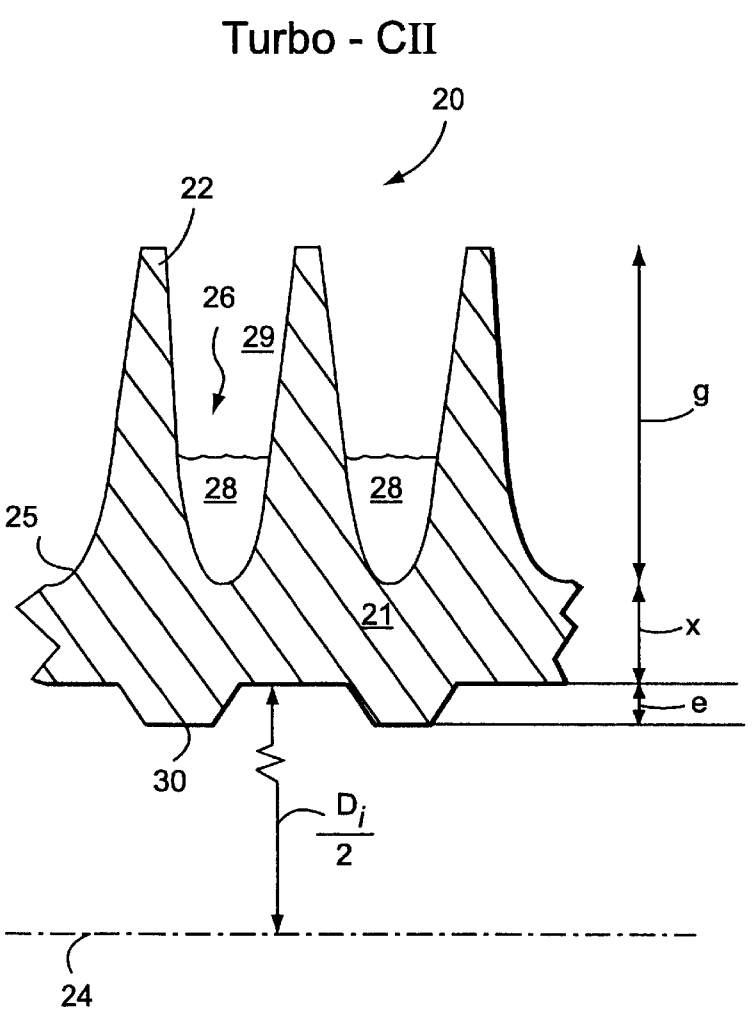
Fig. 1 (Prior Art)
FIG. 1 is an enlarged, partially broken away axial cross-sectional view of a prior art heat transfer tube.

As shown in FIG. 3 tube 100 has broad and substantially flattened channel bottoms 121, as opposed to the narrow and rounded bottoms of the channels 26 of the prior art (see FIG. 1). Such being the case, pools 128 of liquid refrigerant condensing on tube exterior surface 112 are relatively shallow. The shallowness of pools 128 permits refrigerant vapor in channels 120 above the pools to reside as a thin film and to remain close to walls of fins 118 and to tube wall 108, i.e., relatively close to channel bottom 121. Proximity of the refrigerant vapor to tube wall 108 enhances heat transfer, e.g., more rapid condensation of the vapor. With a shallow pool 128, more of fin 118 is exposed to vapor and available for the condensation. In the prior art, by contrast, a deeper pooling of condensate reduces the effective surface area of the fins.

In addiiton to ensuring that pools 128 are shallow, the length of channels 120 also faciliates a greater height (e) for ridges 116.

Figure 5:
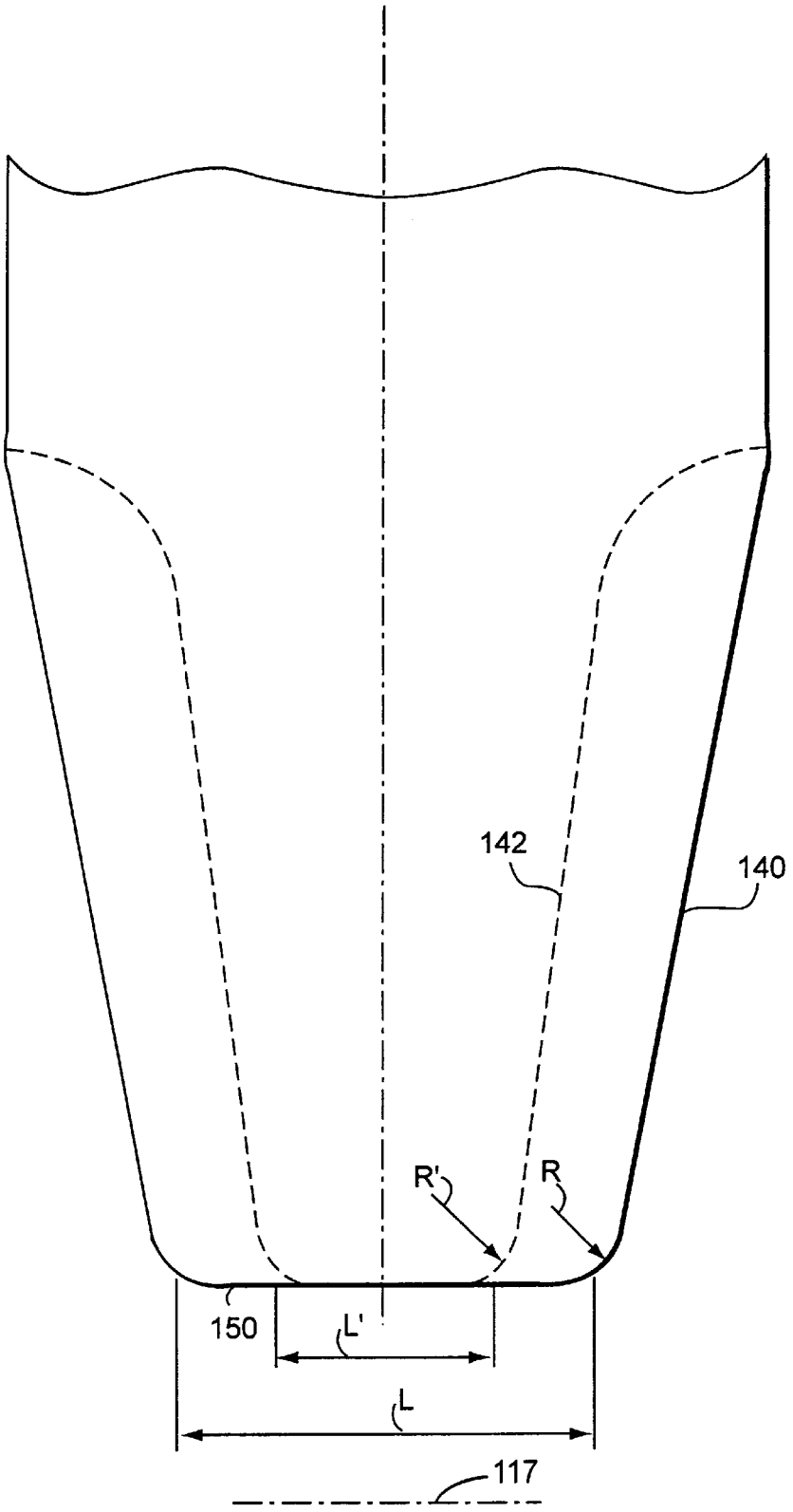
FIG. 5 is an enlarged, axial view of a portion of an operative end of a final finning disk employed to make the heat transfer tube of FIG. 2.

The broad, substantially flat profile of channel bottom 121 results from employment of a comparably shaped finning disk 140. FIG. 5 shows, in solid lines, finning disk 140 used to form channels 120 of illustrated tube 100. In contrast to finning disk 140, a prior art finning disk 142 is shown in broken lines.

FIG. 5 shows an operative portion of finning disk 140. It should be understood that finning disk 140 rotates about an axis which is parallel to longitudinal axis 117 of tube 100. At its circumference, finning disk 140 has edges radiused at R as shown in FIG. 5, with R being 0.005 inch. An axial segment 150 of finning disk 140 forms the substantially flat channel bottom 121, the axial segment 150 being substantially parallel to tube axis 117 and having a length L. In the illustrated embodiment, L is 0.016 inch, which is twice as long as length L' shown with respect to prior art finning disk 142. Prior art finning disk 142 is radiused with R' equal to 0.003 inch.

Heat transfer tubes of the present invention have a ratio of channel bottom length (L) to average fin width in a range of from 1.22 to 3.40, in contrast to a ratio of 0.84 for prior art tube 20. The ratio of channel bottom length to average fin width for illustrated tube 100 is 2.28. Further, the heat transfer tubes of the present invention tube 100 have a ratio of channel bottom length to average fin height in a range of from 0.39 to 0.85, in contrast to a ratio of 0.21 for prior art tube 20. The ratio of channel bottom length to average fin height for illustrated tube 100 is 0.67.

Finning disks of the present invention such as finning disk 140 apply a force in the radial direction (relative to axis 117 for displacement of metal) greater than the radial force applied in the prior art. Such greater force results in the higher ridge height e of ridges 116 while channel length L can also be maintained long, e.g., to reduce tube weight. Accordingly, heat transfer tubes of the present invention have a ratio of the ridge height (e) multiplied by the channel bottom length (L) to ridge base width (b) [i.e., e*L/b ] in a range of from 0.0062 to 0.0165 in contrast to a ratio of 0.004 for prior art tube 20. The ratio of the average ridge height (e) multiplied by the average channel bottom length (L) to the average ridge base width (b) for illustrated tube 100 is 0.0119.

The channel bottom length L for tubes according to the present invention 100 is larger than 45% of fin pitch (Q) and preferably between 45% and 75% of fin pitch (Q). The channel bottom length L for illustrated tube 100 is 69% of fin pitch. The prior art tube 20, on the other hand, has its channel bottom length L' being only 32% of fin pitch.

The increased height e of ridges 116 of tubes of the present invention enhances heat transfer. Heat transfer tubes of the present invention have a ratio of ridge height (e) to ridge base width (b) in a range from 0.565 to 0.973, in contrast to 0.500 for prior art tube 20. The ratio of ridge height (e) to ridge base width (b) for illustrated tube 100 is 0.745.

Heat transfer tubes of the present invention have a ratio of channel bottom length (L) to average ridge width in a range of from 0.389 to 0.752, in contrast to a ratio of 0.269 for prior art tube 20. The ratio of channel bottom length (L) to average ridge width for illustrated tube 100 is 0.627. Thus, although of greater height, ridges 116 are thin. By having thin ridges 116 and thin fins 118, tubes of the present invention, such as tube 100, result in at least a ten percent reduction in the weight of tube 100 as compared to prior art tubes of comparable tube wall thickness.

Thus, heat transfer tubes of the present invention, such as tube 100, have mechanical enhancements which can individually improve either the tube inner surface 112 or the tube outer surface 114, or both, or which can cooperate to increase the overall efficiency. The widened and substantially flattened channel bottom 121, together with the thinner and lower fins 118 and the thinner and higher ridges 116, reduces the weight of the tube and improves heat transfer efficiency. The substantially flattened channel bottom 121 is formed by the axial segment 150 of the finning disk 140, as described in connection with FIG. 5, and therefore has the same width L.

While channel bottom 121 is preferably flat, it should be understood that the invention also covers embodiments in which channel bottom 121 is not perfectly flat, such as slightly undulating, inclined, or tapered surfaces forming channel bottom 121, for which reason the channels 120 are said herein to be "substantially" flat.

Of the tubes described herein, tube outer surface 112 is effective for use with numerous refrigerants including the alternative non-CFC refrigerants, and particularly including the high pressure refrigerant HFC-134A and the low pressure refrigerant HCFC-123.

Table 1 provides parameters of tubes evaluated to provide a graphical comparison (see FIG. 6, FIG. 7, FIG. 8, and FIG. 9) of tubes of the present invention relative to the prior art. In Table 1, Table 2, and the graphs of these figures, T-CIII refers to tube 100 of the present invention; T-Chill refers to the prior art tube described in U.S. Pat. No. 3,847,212 to Withers and commercially known as TURBO-CHIL®; T-C refers to a prior art tube known as Turbo-C™; and T-CII refers to a prior art tube known as Turbo-CII™, all of which are marketed by Wolverine Tube, Inc.

Table 2 compares the inside performances of the tubes of Table 1. All tubes are compared at constant water flow rate of 5 GPM and a constant average water temperature of 95 F.

TABLE 1

| | Dimensional Characteristics of Heat Transfer Tubes | | | |
|---|---|---|---|---|
| TUBE DESIGNATION | T-CHIL | T-C | T-CII | T-CIII |
| PRODUCT NAME | Turbo-Chil ® | Turbo-C ® | Turbo-CII ® | Turbo-CIII ™ |
| FPI = fins per inch (fpi) | 40 | 40 | 40 | 43 |
| posture of fins | Erect | notched | notched | notched |
| FH = Fin Height (inches) | .052 | .038 | .038 | .024 |
| $d_1$ = Inside Diameter (inches) | .573 | .612 | .612 | .639 |
| e = Ridge Height (inches) | .015 | .020 | .015 | .019 |
| p = Axial Pitch of Ridge (inches) | .168 | .091 | .050 | .058 |
| $N_{RS}$ = Number of Ridge Starts | 10 | 30 | 38 | 34 |
| 1 = Lead (inches) | 1.68 | 2.74 | 1.92 | 1.99 |
| θ = Lead Angle of Ridge from Axis (°) | 46.5 | 35 | 45 | 45 |
| b = Ridge Width Along Axis (inches) | .051 | .0593 | .030 | .0255 |
| WPFT (weight [pounds] per foot) | .348 | .4197 | .3866 | .3475 |
| $\phi = e^3/pd_1$ = Severity Factor | 0.00234 | 0.00728 | 0.003866 | 0.00974 |

TABLE 2

Tube Performance Characteristics
Comparisons are based on a nominal ¾" outside diameter tubes. The tube side water flow rate is 5 GPM which is constant for all tubes. The average water temperature is 95 F.

| Tube Identification | T-CHIL | T-C | T-CII | T-CIII |
|---|---|---|---|---|
| u = Intube Water Velocity (ft/s) | 6.23 | 5.48 | 5.48 | 5.03 |
| $C_1$ = Inside Heat Transfer Coefficient Constant (From Test Results) | .052 | .058 | .068 | .078 |
| $f_D$ = Friction Factor (Darcy) | 0.0406 | 0.0490 | 0.0526 | 0.0560 |

TABLE 2-continued

Tube Performance Characteristics
Comparisons are based on a nominal ¾" outside diameter tubes.
The tube side water flow rate is 5 GPM which is
constant for all tubes. The average water temperature is 95 F.

| Tube Identification | T-CHIL | T-C | T-CII | T-CIII |
|---|---|---|---|---|
| $\Delta p_e$/ft = Pressure Drop per Foot | 0.220 | 0.193 | 0.207 | 0.178 |
| $St_e/St_5$ = Stanton Number Ratio (enhanced/Smooth) | 1.71 | 1.99 | 2.33 | 2.70 |
| $\Delta p_e/\Delta p_5$ = Pressure Drop Ratio (Enhanced/Smooth) | 4.52 | 3.96 | 4.25 | 3.65 |
| $\eta = (St_e/St_5)/\Delta p_e/\Delta p_5)$ = Efficiency index | 0.38 | 0.50 | 0.55 | 0.74 |

Figure 6:
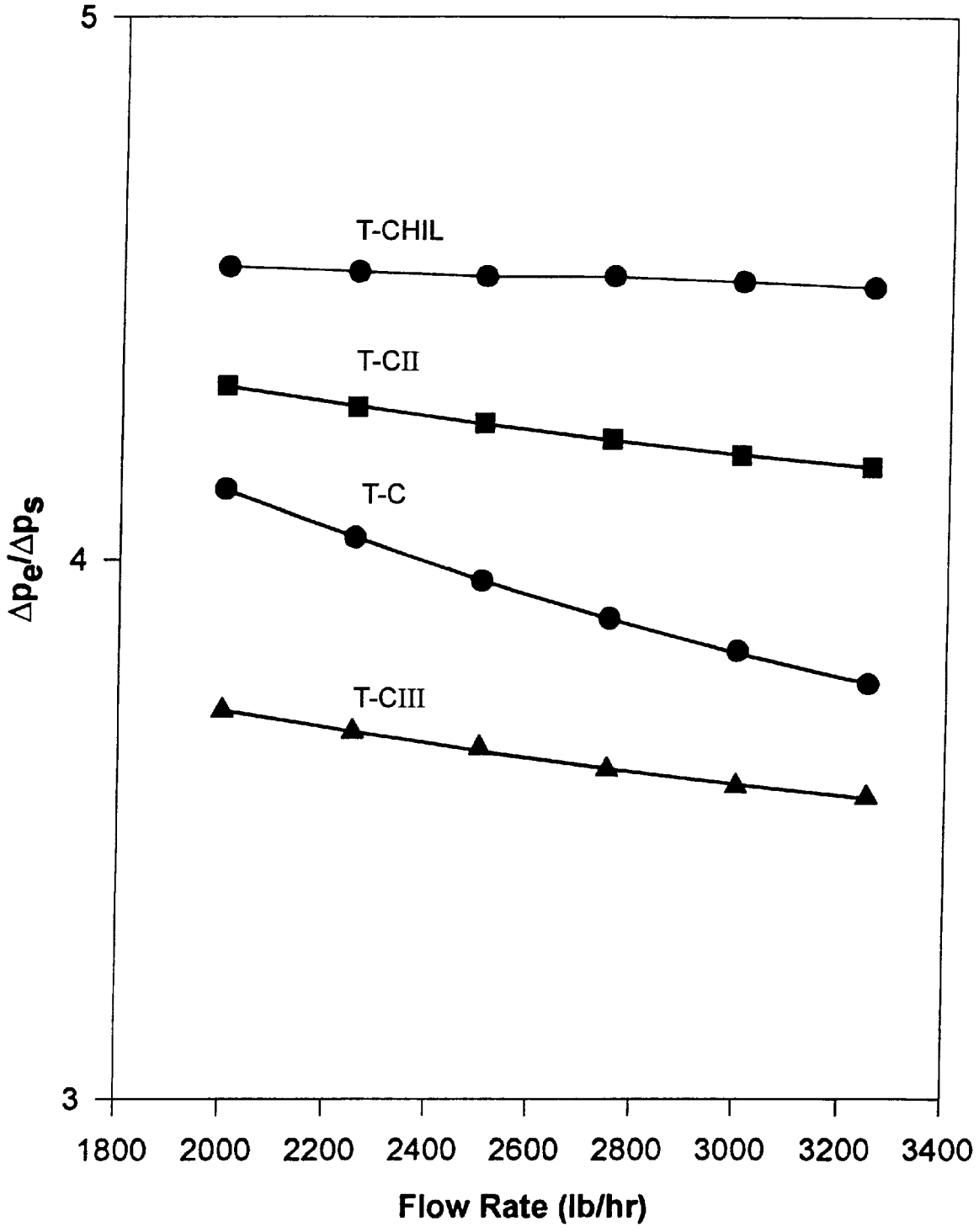
FIG. 6 is a graph comparing pressure drop as a function of flow rate for four different heat transfer tubes.
Figure 7:
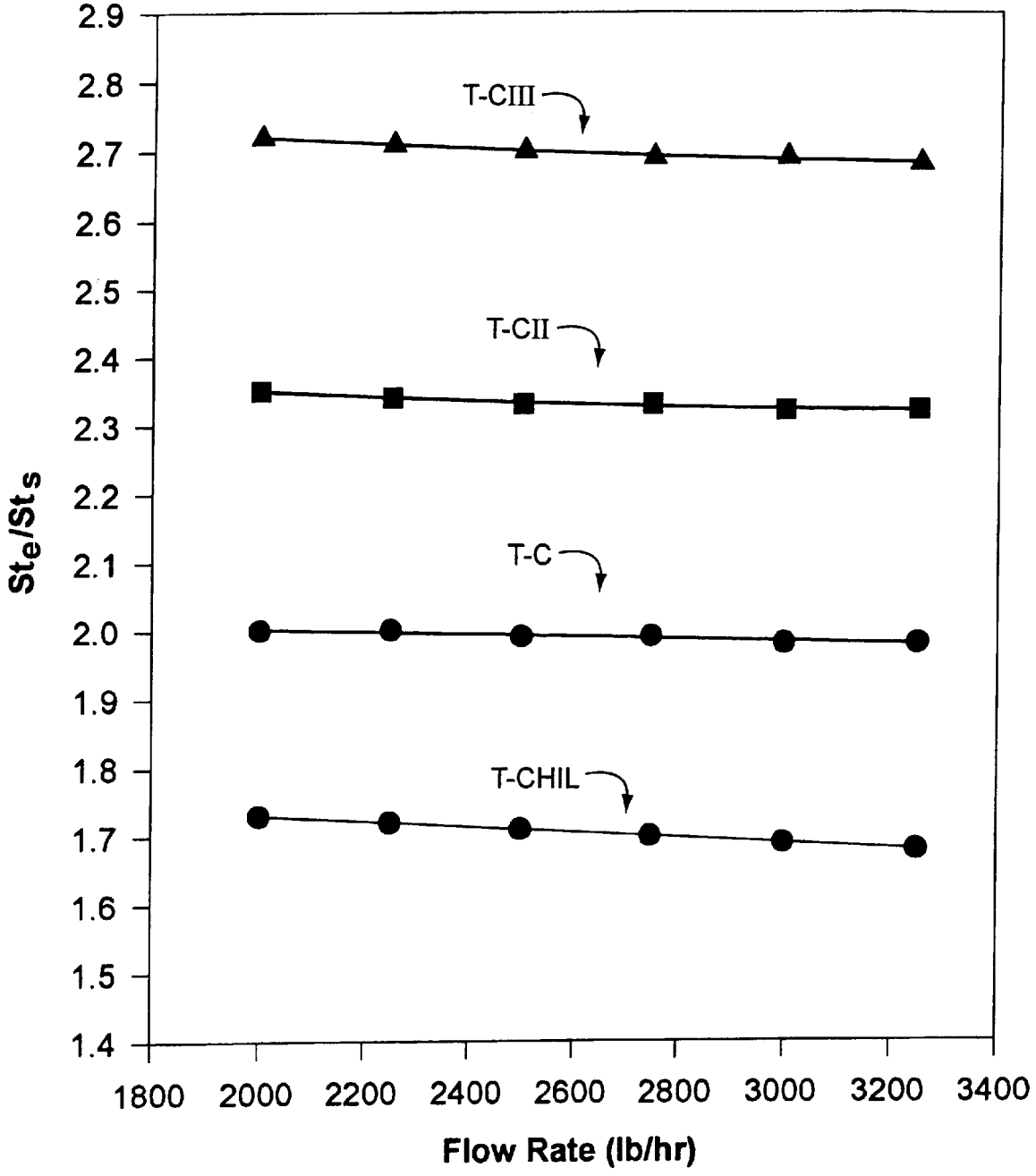
FIG. 7 is a graph comparing Stanton Number as a function of flow rate for four different heat transfer tubes.
Figure 8:
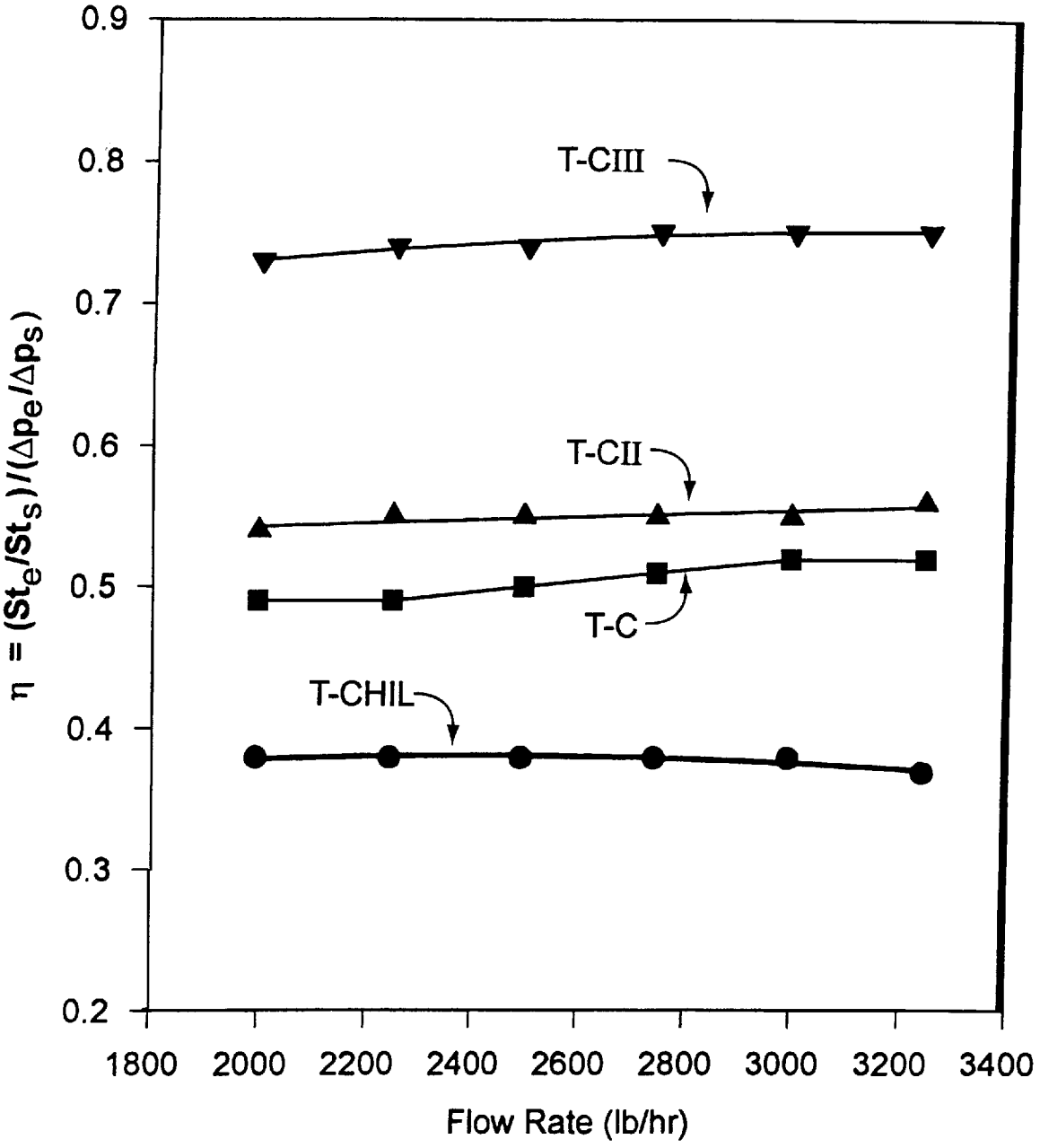
FIG. 8 is a graph comparing an efficiency index as a function of flow rate for four different heat transfer tubes.
Figure 9:
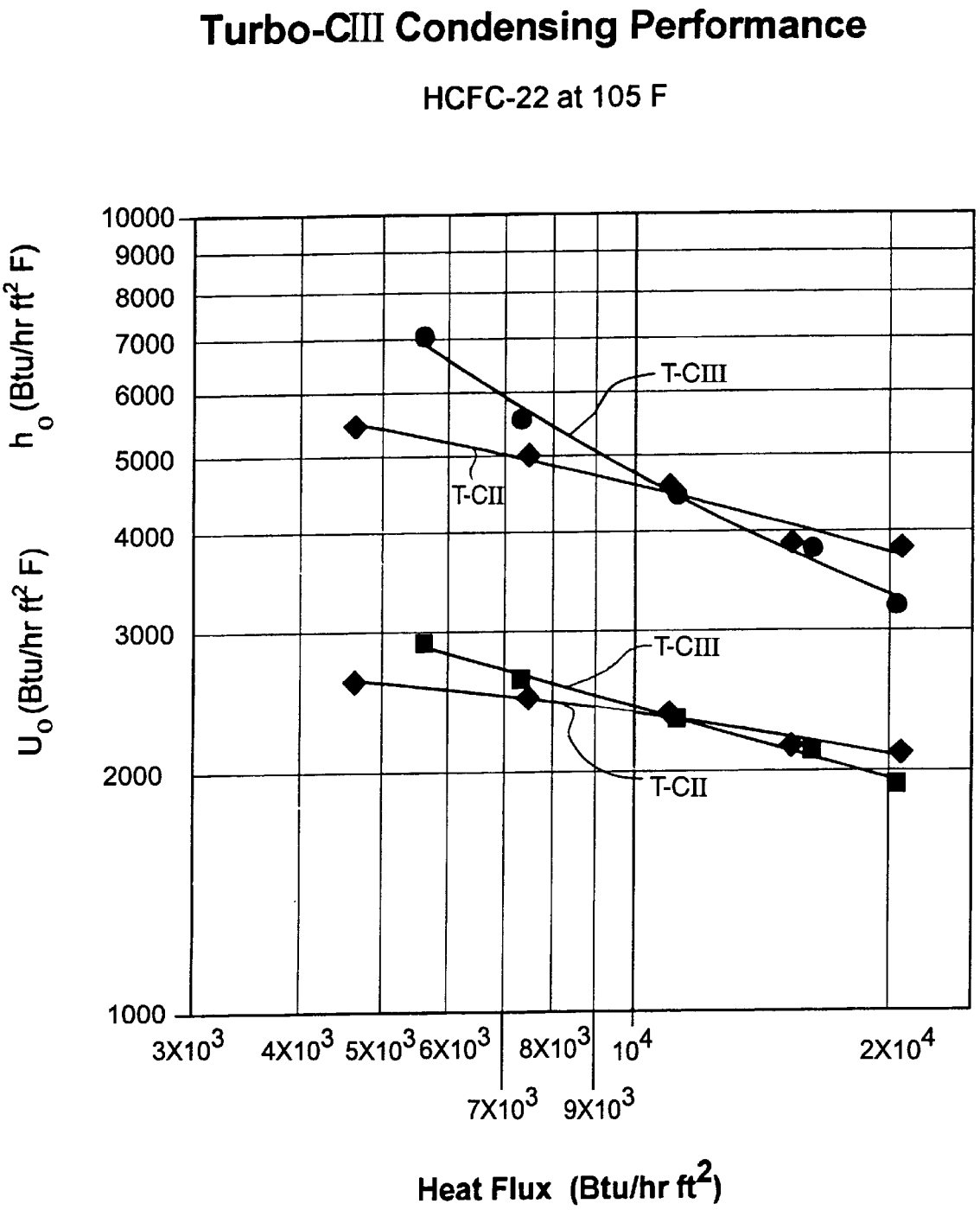
FIG. 9 is a graph comparing the overall heat transfer coefficient $U_o$ and the condensing heat transfer coefficient $h_o$ at varying Heat Fluxes for the tubes shown in FIG. 1 and FIG. 3.

FIGS. 6–8 are graphs showing the comparative advantages of the tubes of the present invention relative to prior art tubes. FIG. 6 is a graph comparing pressure drop as a function of flow rate for the tubes listed in Table 1. FIG. 7 is a graph comparing Stanton Number as a function of flow rate for the tubes listed in Table 1. FIG. 8 is a graph comparing an efficiency index as a function of flow rate for the tubes listed in Table 1. FIG. 9 is a graph comparing the overall heat transfer coefficient $U_o$ and the condensing heat transfer coefficient $h_o$ at varying Heat Fluxes for the tubes shown in FIG. 1 and FIG. 3.

In FIG. 6, it should be understood that the ratio on the vertical axis is the ratio of pressure drop of the charted tube (e) with its enhancement relative to a smooth bore tube (s). The Stanton Number St of FIG. 7 is likewise taken with respect both to the respective enhanced tubes in ratio to a smooth tube of otherwise comparable dimension (the ratio being $St_e/St_s$). The Stanton Number St is well known by the expression St=(Nu)/(RePr). In FIG. 8, $\eta$ represents the efficiency index, which is the ratio of heat transfer increase to pressure drop increase relative to a smooth bore tube. In FIG. 9, $h_o$ represents outside heat transfer coefficient and $U_o$ represents overall heat transfer coefficient.

Although tube 100 as depicted herein is used as a condensing tube, it should be understood that a boiling tube of similar configuration is within the scope of the present invention. In this regard, for tube 100 to function as a boiling tube, after notching the fins 118 can be compressed to result in flattened fin heads, thereby forming boiling pores or nucleation sites in the manner of U.S. patent application Ser. Nos. 08/417,047 and 08/846,576, filed on Apr. 4, 1995 and Jun. 7, 1995, respectively, both of which are incorporated herein by reference. Moreover, in addition to the notching shown herein, fins 118 can be cross notched as understood from the aforementioned incorporated patent properties.

While the invention has been particularly shown and described with reference to the preferred embodiments thereof, it will be understood by those skilled in the art that various alterations in form and detail may be made therein without departing from the spirit and scope of the invention.

The embodiments of the invention in which an exclusive property or privilege is claimed are defined as follows:

1. A seamless heat transfer condensing tube of a type which has an exterior surface comprising a plurality of integral, helically arranged, radially outwardly extending fins which are thinner at their tips than at their base and are adapted to be contacted by a refrigerant, said tube having an inner surface which includes a plurality of integral, helically arranged, radially inwardly extending ridges which define a path through which a liquid is conveyed in an axial direction of the tube, the fins having a pitch Q with respect to the axial direction of the tube, with a channel provided between adjacent fins, the channels having a channel bottom of a length L with respect to the axial direction of the tube, wherein L is greater than 45% of fin pitch Q, wherein said plurality of radially outwardly extending fins have an average width v with respect to the axial direction of the tube, and wherein a ratio of L/v is 2.28.

2. A seamless heat transfer condensing tube of a type which has an exterior surface comprising a plurality of integral, helically arranged, radially outwardly extending fins which are thinner at their tips than at their base and are adapted to be contacted by a refrigerant, said tube having an inner surface which includes a plurality of integral, helically arranged, radially inwardly extending ridges which define a path through which a liquid is conveyed in an axial direction of the tube, the fins having a pitch Q with respect to the axial direction of the tube, with a channel provided between adjacent fins, the channels having a channel bottom of a length L with respect to the axial direction of the tube, wherein L is greater than 45% of fin pitch Q, and wherein the plurality of radially inwardly extending ridges included on the inner surface of the tube have a ridge height (e) and a ridge base width (b), and wherein a ratio of eL/b is in a range of from 0.0062 to 0.0165.

3. A heat transfer tube according to claim 2 wherein said plurality of radially outwardly extending fins have an average width v with respect to the axial direction of the tube and wherein the ratio of L/v is in a range of from 2.0 to 3.40.

4. The tube of claim 2, wherein the ratio of eL/b is 0.0119.

5. A heat transfer tube according to claim 2 wherein a ratio of e/b is in a range of from 0.565 to 0.973.

6. The tube of claim 5, wherein the ratio of e/b is 0.745.

7. A seamless heat transfer condensing tube of a type which has an exterior surface comprising a plurality of integral, helically arranged, radially outwardly extending fins which are thinner at their tips than at their base and are adapted to be contacted by a refrigerant, said tube having an inner surface which includes a plurality of integral, helically arranged, radially inwardly extending ridges which define a path through which a liquid is conveyed in an axial direction of the tube, the fins having a pitch Q with respect to the axial direction of the tube, with a channel provided between adjacent fins, the channels having a channel bottom of a length L with respect to the axial direction of the tube, wherein L is greater than 45% of fin pitch Q, and wherein the plurality of radially inwardly extending ridges included on the inner surface of the tube have an average ridge width, and wherein a ratio of L to average ridge width is in a range of from 0.389 to 0.752.

8. The tube of claim 7, wherein L is between 45% and 75% of fin pitch Q.

9. The tube of claim 7, wherein L is 69% of fin pitch Q.

* * * * *